United States Patent [19]

Hall, Jr. et al.

[11] 4,374,073

[45] Feb. 15, 1983

[54] METHOD OF MAKING A HEAT-SEALED PYROTECHNIC CAP

[75] Inventors: Harold H. Hall, Jr., Marblehead; Andre C. Bouchard, Peabody, both of Mass.; John W. Shaffer; Thomas L. Gavenonis, both of Williamsport, Pa.

[73] Assignee: GTE Products Corporation, Stamford, Conn.

[21] Appl. No.: 194,709

[22] Filed: Oct. 6, 1980

Related U.S. Application Data

[62] Division of Ser. No. 2,263, Jan. 10, 1979, Pat. No. 4,267,774.

[51] Int. Cl.[3] ..... C06B 21/00

[52] U.S. Cl. ..... 264/3 R; 86/1 R

[58] Field of Search ..... 264/3 R, 3 C; 86/1 R; 102/470

[56] References Cited

U.S. PATENT DOCUMENTS

| | | | |
|---|---|---|---|
| 2,868,128 | 1/1959 | Ramsey | 102/470 X |
| 2,958,171 | 11/1960 | Deckers | 264/3 R X |
| 3,655,836 | 4/1972 | Dehm et al. | 264/3 R X |
| 3,716,604 | 2/1973 | Dehm | 264/3 R X |
| 3,882,208 | 5/1975 | Geresy, Jr. | 264/3 C |
| 4,050,347 | 9/1977 | Adelman et al. | 264/3 R X |
| 4,315,462 | 2/1982 | Vollers | 102/470 X |

*Primary Examiner*—Peter A. Nelson

*Attorney, Agent, or Firm*—Lawrence R. Fraley

[57] ABSTRACT

A method of making a hermetically-sealed pyrotechnic cap is described which includes a plastic (e.g. polyethylene) container and a quantity of pyrotechnic mixture therein. Closure of the container is achieved by heat-sealing an end thereof.

12 Claims, 8 Drawing Figures

METHOD OF MAKING A HEAT-SEALED PYROTECHNIC CAP

This is a division of application Ser. No. 2,263, filed Jan. 10, 1979, and now U.S. Pat. No. 4,267,774.

CROSS REFERENCE TO RELATED PATENTS AND CO-PENDING APPLICATIONS

An application under Ser. No. 2,264 was filed Jan. 10, 1979. Ser. No. 2,264, entitled "Pyrotechnic Cap With Mechanically Desensitized Composition" (Inventors: T. L. Gavenonis et al) defines a hermetically sealed cap adapted for being activated by radiant energy and containing a composition capable of withstanding high compressive forces without igniting.

An application under Ser. No. 2,265, entitled "Radiant Energy Activated Pyrotechnic Cap Having Desiccant Therein" (Inventor: J. W. Shaffer), was also filed Jan. 10, 1979. This application is now U.S. Pat. No. 4,244,295, which issued Jan. 13, 1981. The cap in U.S. Pat. No. 4,244,295 includes a non-deliquescent desiccant to absorb any moisture which may exist within the cap after hermetically sealing thereof.

An application under Ser. No. 2,272, entitled "Pyrotechnic Cap With Moisture Indicator" (Inventors: A. C. Bouchard et al) was also filed Jan. 10, 1979, and is now U.S. Pat. No. 4,263,850. In U.S. Pat. No. 4,263,850, a pyrotechnic cap is provided with a color changing member to indicate the presence of moisture inside the sealed cap.

All of the above are assigned to the assignee of the present invention.

U.S. Pat. No. 4,130,082 filed June 6, 1977 and entitled "Flashlamp Assembly For Providing Highly Intense Audible and Visual Signals" (A. C. Bouchard et al), describes a pyrotechnic cap which is adapted for being activated by the light and/or heat from a flashlamp. U.S. Pat. No. 4,130,082 is also assigned to the same assignee as the present invention.

BACKGROUND OF THE INVENTION

The invention relates to pyrotechnic caps and to methods for manufacture thereof. More particularly, the invention is concerned with caps of the above variety which are hermetically sealed.

In the aforementioned U.S. Pat. No. 4,130,082, there is described a pyrotechnic cap which produces a highly intensive audible signal (e.g. 158 to 164 decibels at 25 centimeters) when activated by a chemical flashlamp. A quantity of pyrotechnic mixture is hermetically sealed within the cap's plastic container to assure provision of the described signal in addition to protecting the mixture against adverse environmental conditions. The defined means for sealing the cap in U.S. Pat. No. 4,130,082 includes utilization of a thin transparent cover member which is secured over the top end of the container, or locating a quantity of sealing material such as epoxy or paraffin within the container immediately above the pyrotechnic mixture.

The present invention represents an improvement to the above by providing a flashlamp-activated pyrotechnic cap which is hermetically sealed without the need for additive items such as epoxy, paraffin, or transparent covers. The invention is thus less expensive to manufacture and more suitable to mass production techniques.

It is believed, therefore, that a method of making a flashlamp-activated pyrotechnic cap which is relatively inexpensive to produce, adaptable to high volume production, and assures a hermetic seal of the cap's pyrotechnic mixture without the necessity for additional sealing items such as epoxy, paraffin, or transparent covers would constitute an advancement in the art.

OBJECTS AND SUMMARY OF THE INVENTION

It is, therefore, a primary object of the present invention to enhance the pyrotechnic cap art by providing a method of making a cap having the advantageous features defined above.

According to one aspect of the invention, a method is provided for making a pyrotechnic cap which includes the aforedescribed plastic container and mixture therein. The method includes engaging the side walls of the open-ended container with a heated platen to form a heat seal between the walls.

DETAILED DESCRIPTION OF THE PREFERRED EMBODIMENTS

Figure 1:
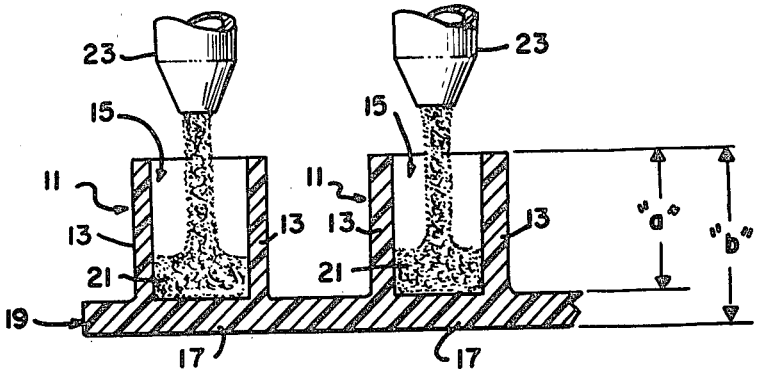
FIGS. 1–4 represent the steps of making a pyrotechnic cap in accordance with a preferred embodiment of the invention.

For a better understanding of the present invention together with other and further objects, advantages and capabilities thereof, reference is made to the following disclosure and appended claims in connection with the above-described drawings.

With particular reference to FIGS. 1–4, there is shown a method for making a pyrotechnic cap in accordance with a preferred embodiment of the invention. The method involves providing a plastic container 11 which, in cross-section, includes at least two upstanding side walls 13 to define an open end 15 for the container. The plastic material for container 11 is a thermoplastic, preferably high density polyethylene. It is understood, however, that other plastics could be used, including low density polyethylene, polypropylene, polyvinyl chloride, polycarbonates, etc. The container as shown is preferably cylindrical in configuration but could, of course, assume other shapes, including rectangular, hexagonal, etc. Each container 11 also includes a base portion 17 to define a closed end at this portion of the container. It is preferred in the present invention to simultaneously produce several pyrotechnic caps. Accordingly, the base portions 17 of each container 11 comprise part of a large plastic substrate 19 which in one embodiment of the invention contained approximately 200 containers. After formation, each container is cut from the substrate to provide an individual cap member. On some occasions, pairs of adjoining containers were removed. It is to be understood that the above parameters are not meant to limit the present invention in that larger numbers of caps may be readily produced from a single substrate. The invention is thereby ideally suited for mass production, in addition to assuring an economically feasible means of cap manufacture.

In FIG. 1, each container 11 is shown as receiving a quantity of pyrotechnic mixture 21 which is deposited from suitable dispensers 23 located above the containers. Mixture 21 is supplied in slurry form and is deposited through open ends 15. Examples of mixtures for use in the invention are described in the aforementioned U.S. Pat. No. 4,130,082. A preferred composition is one containing potassium chlorate, red phosphorous, manganese dioxide, and a dispersing agent.

Pyrotechnic compositions known as "Armstrong's Mixtures" may also be used with the present invention. These compositions typically include potassium chlorate within the range of about 67 to 81 percent, phosphorous from about 8 to 27 percent, sulfur from about 3 to 9 percent, and precipitated chalk from about 3 to 11 percent. All of these percentages are by weight of the total mixture.

As an alternate embodiment, it may be desirable to use a pyrotechnic mixture which emits a "whistling" or similar sound. Such compositions are also well known in the art art may contain potassium chlorate, potassium perchlorate, potassium nitrate, red gum, gallic acid, potassium picrate, potassium benzoate, potassium dinitrophenate and sodium salicylate. These formulations are shown on pages 376 and 377 of the book entitled "Military and Civilian Pyrotechnics" by Dr. Herbert Ellern, copyright 1968 by The Chemical Publishing Co., Inc. The aforementioned "Armstrong's Mixtures" are defined on page 353 of this text.

The above nonwhistling compositions assure an audible signal of high intensity when the cap is activated by the energy from an adjacent flashlamp. By high intensity is meant an output of above 85 decibels measured at a distance of 10 inches. The preferred range, as stated above, is from about 158 to about 164 decibels at this distance.

Walls 13 are each approximately 0.020 inch thick and about 0.135 inch tall (dimension "a") while base 17 has a thickness of about 0.025 inch. The overall height (dimension "b") of each container 11 is thereby approximately 0.160 inch in the initial form as represented in FIG. 1. Still further, each container has an internal diameter of about 0.140 inch and is spaced at a distance of 0.060 inch from the nearest adjacent container. Approximately 5 to 10 milligrams of pyrotechnic mixture 21 are deposited within each container to occupy a height of about 0.005 to 0.010 inch. This amount is not meant to limit the invention, however. In containers of the sizes defined above, quantities ranging from about 3 to 17 milligrams are used. Drying of the slurry is accomplished by placing the containers in a circulating air oven at 140° F. for about 30 minutes. The oven's temperature is thereafter raised to 212° F. for a period of about 48 hours after which the containers are removed and permitted to cool to room temperature.

The next step in the preferred embodiment of the invention involves surrounding each container 11 with a rigid, heat conductive member 25. By rigid is meant a member which maintains its shape during the heat-sealing step of the invention to thus lend support to the exterior surfaces of walls 13 and maintain integrity thereof. Further, member 25 serves as a heat sink to conduct heat away from each container 11 during this sealing operation. A preferred material for member 25 is steel, although other materials such as copper and aluminum are acceptable. Accommodation of the containers is possible by providing member 25 with a plurality of cylindrical apertures 27. Each aperture preferably forms an interference fit with the respective container and therefore possesses an internal diameter approximately equal to the external diameter of containers 11. It is possible for this internal diameter to exceed the container's outer diameter by about 0.010 inch and still permit member 25 to perform as desired. As stated however, the member preferably maintains engagement with the exterior surfaces of each container.

To facilitate separation of excessive cap material from the formed cap, member 25 includes an upstanding, truncated region 28 about each aperture 27. Regions 28 each include a narrow, flat edge 29 on the upper end thereof, said edge surrounding aperture 27. The outer surfaces 33 of regions 28 are established at an angle ("c" in FIG. 2) with the exterior surfaces of containers 11. Angle "c" is approximately 45 degrees.

Figure 2:
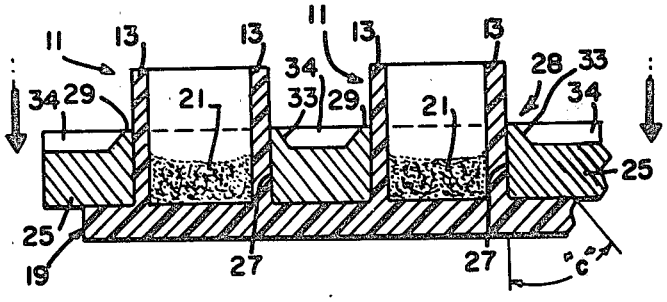
Figure 3:
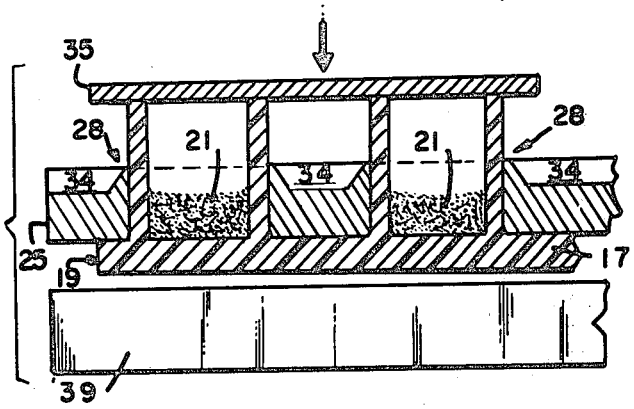

As shown in FIG. 2, portions of each side wall 13 project above the uppermost surface (edge 29) of member 25. Accordingly, the next step in the method of the invention preferably involves locating a thin, pliable heat conductor 35 atop containers 11 (FIG. 3). Conductor 35 is a strip of aluminum foil having a thickness of about 0.005 inch. As one example, conductor 35 was No. 1145 Alloy, zero temper aluminum foil purchased from the Consolidated Aluminum Corp., Jackson, Tenn.

The sandwiched elements depicted in FIG. 3 were then placed in a press in which an air-driven, preheated first platen 37 (FIG. 4) was lowered to effect contact with foil 35. Platen 37 was heated to within the range of about 350° F. to 450° F. which is between 75 and 175 degrees F. above the softening temperature of the polyethylene material of container 11. Contact was momentarily (1–2 seconds) maintained to achieve pre-softening and "mushrooming" of the portions of the cup's walls 13 which projected above member 25. Approximately 15 to 45 p.s.i. was thereafter applied to the upper platen which caused the projecting ends of the plastic walls 13 to flow inwardly and fill the region immediately above the dry pyrotechnic mixture 21. The result was an unexpectedly neat and strong hermetic seal (see FIG. 5).

A portion of the plastic material flowed radially outward to cause a thin flashing of plastic to form about the upper edge 29 of each aperture 27 and, in some cases, to occupy the recesses 34 formed between upstanding regions 28. This excessive material was efficiently removed by edges 29 during separation of the finished caps and member 25. The entire heating and sealing operation took from about 0.5 to 15 seconds, depending on the temperatures and pressures utilized. Understandably, the greater the temperatures and pressure, the less time was required to effect an adequate seal. In those instances wherein excess material occupied recesses 34, it was possible to reduce the aforedescribed pressures applied to upper platen 37.

Prior to engaging foil 35 with the heated first platen 37, substrate 19 (and therefore base portions 17) was engaged by a bottom platen 39 which was maintained at normal room temperature. Both platens 37 and 39 were preferably aluminum with upper platen 37 heated by resistance heaters located therein.

Subsequent to sealing the individual containers, upper platen 37 was removed (raised) and the substrate, having the several sealed containers thereon, was permitted to cool. As stated earlier, this cooling was enhanced by the conductive member 25 which maintained engagement with the containers during this removal and acted as a heat sink therefor. The desired cooling temperature was about 100° to 110° F. after which the aluminum foil 35 was removed. As stated, excessive flashing was expeditiously removed by the truncated regions 28 during separation of member 25 from the respective containers.

It was found that in order to effect a good seal, care was required during the heat sealing to assure that the plastic flowing into the cavity above the pyrotechnic material flowed down to the surface of said material. Accordingly, the pyrotechnic acted as a support for the plastic. In addition, the final product was essentially free of unwanted pockets of air, moisture, etc., which could alter the overall configuration of the product and/or the combustibility of the explosive pyrotechnic mixture.

Figure 4:
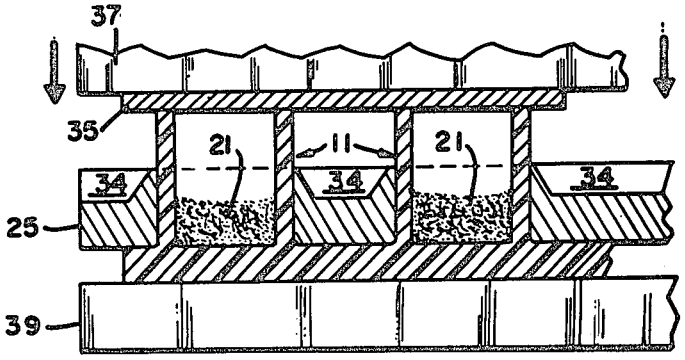

In an alternative embodiment of the invention, caps were formed using all the components illustrated in FIGS. 2–4 with the exception of foil 35. Use of foil 35 is considered important, however, and therefore preferred because as a separate, highly malleable component, it permits partial imprinting thereof by the upper edges 29 of the steel member 25 in such a manner that excessive plastic (flashing) is facilely removed from the cap without the upper surfaces 29 or the bottom of platen 37 being adversely affected. Of added significance, foil 35 is readily separable from member 25 after cooling thereof. As an example, peeling of the foil by hand was possible.

With further regard to the invention, it is to be understood that platens 37 and 39 need not be flat as indicated in the drawings but may be of any configuration which conforms to that of containers 11. In one embodiment, it may be possible to provide recesses within upper platen 37 designed to accommodate the projecting portions of walls 13. Other modifications are similarly within the scope of the invention.

Figure 5:
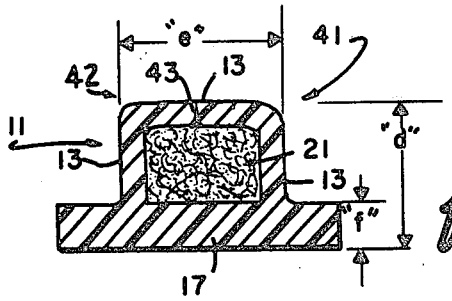
FIGS. 5–8 are various views of pyrotechnic caps produced in accordance with preferred embodiments of the invention.

In FIG. 5 there is shown a pyrotechnic cap 41 as produced by the method described above. Cap 41 includes the defined container 11 which in turn includes the side walls 13 and base portion 17. The desired pyrotechnic mixture 21 is illustrated as being hermetically sealed within container 11 by the upper, heat-sealed end 42 formed between walls 13. In final form, cap 11 preferably has an overall height (dimension "d") within the range of about 0.110 to 0.140 inch. The cylindrical container portion 11 of the cap maintains the outer diameter (dimension "e") of about 0.180 inch while the base thickness (dimension "f") is about 0.025 inch.

As stated, the cap is hermetically sealed by formation of a heat seal between the end portions of walls 13 which projected above the conductor members 25 (FIGS. 2–4) during the aforedefined sealing process. In some instance, a line of demarcation 43 was detectable in the upper end of the cap while in others, this line was non-existent as a result of apparent fusing. In either case, a sound hermetic seal was produced.

Figure 6:
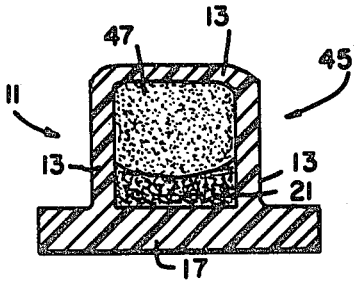

The cap 45 of FIG. 6 represents an alternative embodiment of the present invention. Like cap 41, cap 45 includes the cylindrical container 11 with side walls 13 and base 17, in addition to pyrotechnic mixture 21. In cap 45 however, a non-reactive filler 47 has been added immediately above mixture 21 and beneath the formed seal. By non-reactive is meant a filler which provides the aforedescribed means of support for the heat seal in addition to being inert toward mixture 21. Specifically, the filler should also be non-catalytic toward the phosphorous within mixture 21 as well as free of any moisture which might transfer to the pyrotechnic under prolonged storage conditions.

In the event that cap 45 is to comprise part of a household alarm system (as disclosed in U.S. Pat. No. 4,130,082), it is further preferred that the filler be non-toxic, odorless, non-allergenic, non-flame transporting, and non-smudge-producing (should not contribute to producing visible or discolored smudges on surfaces proximate the alarm system).

It is preferred in the instant invention to utilize a powdered filler of the same material as container 11, e.g. polyethylene. This material is added to cap 45 prior to engagement of the projecting portions of walls 13 with the heat conductive foil 35. Like the mixture 21 in cap 41, filler 47 supports the heat seal during formation thereof. Analysis of cap 45 also indicated that portions of filler 47 participated in the seal by fusing with the inwardly converging walls 13. In most cases, a line of demarcation similar to that shown in FIG. 5 was not detectable. The preferred quantity of filler 47 added to cap 45 during formation thereof was within the range of about 3 to 40 milligrams.

Figure 7:
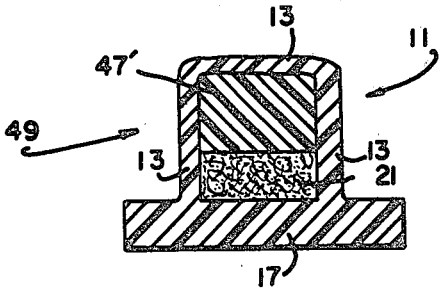
Figure 8:
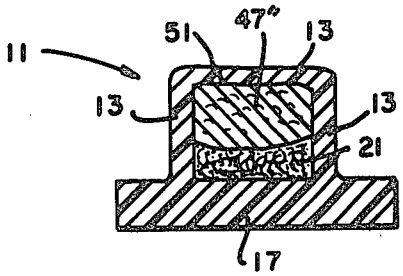

Added types of fillers are illustrated in FIGS. 7 and 8. In FIG. 7, the filler comprises a cylindrical solid disk which is located atop mixture 21 prior to heat sealing the cap (49). It is preferred in this embodiment that disk 47' not fuse with the sealing walls 13. Suitable materials for disk 47' include cardboard, sponge, paper, rubber, and metal foil. In one example, disk 47' had an external diameter of about 0.140 inch (approximately the same as the container's internal diameter) and a thickness of about 0.030 inch.

In the embodiment of FIG. 8, filler 47'' comprises a paper wadding 51 located above mixture 21 and also contiguous with the formed heat seal. Wadding 51, having a thickness of about 0.040 inch, was positioned within container 11 immediately prior to formation of the described heat-seal.

Thus there has been shown and described a method of making a pyrotechnic cap wherein the cap includes a heat-sealed end which serves to hermetically seal the cap's pyrotechnic mixture therein. In another embodiment, a method of making a cap was described wherein a nonreactive filler was added to the cap's container immediately prior to effecting the above heat seal. The filler, preferably in either powder or solid form, substantially filled the container's cavity located above the pyrotechnic mixture after which the container's walls were subjected to the heat-sealing temperature defined. A positive seal of sufficient thickness was formed as a result of partial settling of the container's contents during the pressure application stage of the process.

While there have been shown and described what are at present considered the preferred embodiments of the invention, it will be obvious to those skilled in the art that various changes and modifications may be made therein without departing from the scope of the invention as defined by the appended claims.

We claim:

1. A method of making a pyrotechnic cap for providing an audible signal of high intensity upon receipt of energy in the form of light and/or heat from a flashlamp; said method comprising:

providing a plastic container having in cross-section at least two side walls, said side walls defining an open end within said container;

depositing a quantity of pyrotechnic mixture within said container through said open end, said mixture occupying a predetermined level within said container; and engaging said side walls with a heated first platen to form a heat-seal between said walls, said heat-seal hermetically sealing said open end.

2. The method according to claim 1 wherein said plastic container includes a base portion, said method further including engaging said base portion with a second platen prior to engaging said side walls with said heated first platen.

3. The method according to claim 1 further including substantially surrounding the exterior surfaces of said side walls of said container with a rigid, heat conductive member prior to engaging said side walls with said heated first platen.

4. The method according to claim 3 wherein said heat conductive member engages said exterior surfaces of said side walls.

5. The method according to claim 3 wherein portions of said side walls of said container project from said heat conductive member, said heated first platen engaging only said projecting portions of said side walls to form said heat seal.

6. The method according to claim 1 wherein said pyrotechnix mixture occupies only a portion of said container, said method further including substantially filling the remainder of said container with a nonreactive filler prior to engaging said side walls with said heated first platen.

7. A method of making a pyrotechnic cap for providing an audible signal of high intensity upon receipt of energy in the form of light and/or heat from a flashlamp, said method comprising:

providing a plastic container having in cross-section at least two side walls, said side walls defining an open end within said container;

depositing a quantity of pyrotechnic mixture within said container through said open end, said mixture occupying a predetermined level within said container;

engaging said side walls with a thin, pliable heat conductor; and engaging said pliable heat conductor with a heated first platen only when said heat conductor engages said side walls to form a heat-seal between said walls, said heat-seal hermetically sealing said open end.

8. The method according to claim 7 wherein said plastic container includes a base portion, said method further including engaging said base portion with a second platen prior to engaging said pliable heat conductor with said heated first platen.

9. The method according to claim 7 further including substantially surrounding the exterior surfaces of said side walls of said container with a rigid, heat conductive member prior to engaging said pliable heat conductor with said heated first platen.

10. The method according to claim 9 wherein said heat conductive member engages said exterior surfaces of said side walls.

11. The method according to claim 9 wherein portions of said side walls of said container project from said heat conductive member, said pliable heat conductor engaging only said portions of said side walls to form said heat seal.

12. The method according to claim 7 wherein said pyrotechnic mixture occupies only a portion of said container, said method further including substantially filling the remainder of said container with a nonreactive filler prior to engaging said side walls with said pliable heat conductor.

* * * * *